United States Patent [19]

Landry

[11] 4,085,530

[45] Apr. 25, 1978

[54] BACK HOE RIPPER-TRENCHER CONVERTER

[76] Inventor: Ronald L. Landry, 1604 Glendale Ave., Windsor, Ontario, Canada

[21] Appl. No.: 720,052

[22] Filed: Sep. 2, 1976

Related U.S. Application Data

[63] Continuation of Ser. No. 554,983, Mar. 3, 1975, abandoned.

[51] Int. Cl.[2] ..... E02F 5/02; E02F 9/28

[52] U.S. Cl. ..... 37/98; 37/103; 37/141 R; 172/247; 172/699; 172/713; 172/719

[58] Field of Search ..... 37/103, 98, 117.5, 141 R, 37/142 R, 193; 172/699, 700, 719, 250, 770, 771, 247, 253, 699, 719, 713, 720

[56] References Cited

U.S. PATENT DOCUMENTS

| | | | |
|---|---|---|---|
| 1,299,676 | 4/1919 | Campbell | 172/700 X |
| 2,625,870 | 1/1953 | Peacock et al. | 37/142 R |
| 2,652,640 | 9/1953 | Schield | 37/103 |
| 2,796,012 | 6/1957 | Botha | 172/699 |
| 3,063,176 | 11/1962 | Larson | 37/142 R |
| 3,259,087 | 7/1966 | Horton | 172/719 X |
| 3,305,951 | 2/1967 | Nunn | 172/700 X |
| 3,387,668 | 6/1968 | Mathers | 172/719 |
| 3,675,349 | 7/1972 | Luck | 37/117.5 |
| 3,880,242 | 4/1975 | Rogers | 172/700 X |

FOREIGN PATENT DOCUMENTS

| | | | |
|---|---|---|---|
| 1,388,865 | 12/1965 | France | 172/699 |
| 2,331,327 | 6/1973 | Germany | 37/141 R |
| 785,825 | 11/1957 | United Kingdom | 172/719 |

*Primary Examiner*—Edgar S. Burr
*Assistant Examiner*—Steven A. Bratlie
*Attorney, Agent, or Firm*—Charles Krassov

[57] ABSTRACT

This invention consists of a device which is attached to the pavement ripper of a back-hoe machine in order to convert the ripper into a combined ripper and trench digger so that the ripping of the pavement and the subsequent digging of the trench is accomplished in a single operation. The device consists of a heavy steel plate which terminates into a sharp digging edge at one end thereof. This plate is bent to conform with the ripper edge of a standard back-hoe ripper, upon which it rests, and is held in position at one end by fitting into an undercut part of the ripper and by two spaced side walls attached to the underside of the upper plate. At this end it is also pinned or bolted to the ripper. At the digging end, this plate is provided with a wedge-shaped pocket in which is located the horn end of the ripper to provide additional attachment of the device to the ripper. The width of the upper plate determines the width of the trench to be cut. A lower and shorter steel plate is located directly under the said upper plate to provide reinforcement.

1 Claim, 5 Drawing Figures

BACK HOE RIPPER-TRENCHER CONVERTER

This is a continuation of application Ser. No. 554,983 filed Mar. 3, 1975 now abondoned.

This invention relates generally to mechanized digging equipment, and particularly to a device which combines the pavement ripping operation and the consequent trench digging operation, as done by a back-hoe machine, into a single operation.

Prior to this invention, the procedure used in digging trenches for the repair or laying of new pipes, cables, and various other underground installations, in which a back-hoe is used, was to rip open various types of pavement which cover the area where the trench was to be dug by means of a ripper attached to the back-hoe. Then, the ripper was replaced with some motorized digging accessory. This involved a considerable amount of costly labor and time loss.

It is therefore the primary object of this invention, to provide a device which combines both the ripping and digging into a single operation.

Another object of the invention is to provide such a device of very simple and inexpensive construction, and a further object of this invention is to make this device a part of an existing ripper attachment thus avoiding the complete displacement of the ripper attachment which is at present a standard part of back-hoe machines.

This is accomplished in the invention by its particular design which makes it attachable to the existing standard type of ripper.

Figure 1:
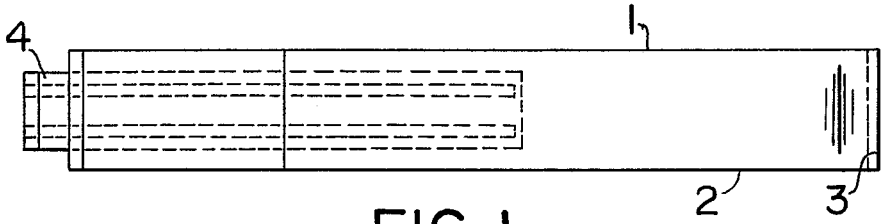
Figure 2:
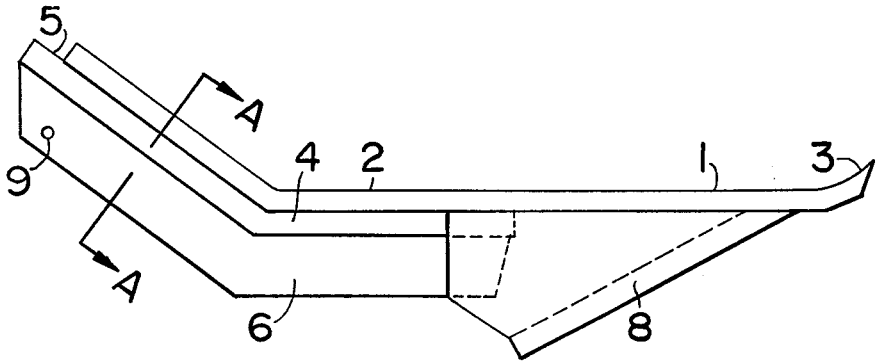
Figure 3:
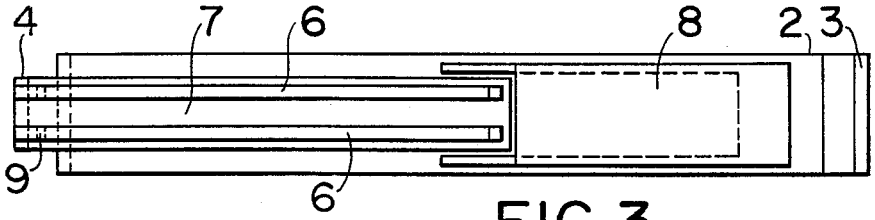
Figure 4:
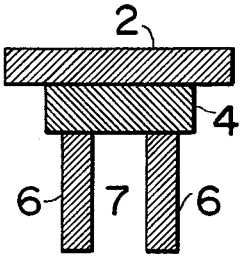
Figure 5:
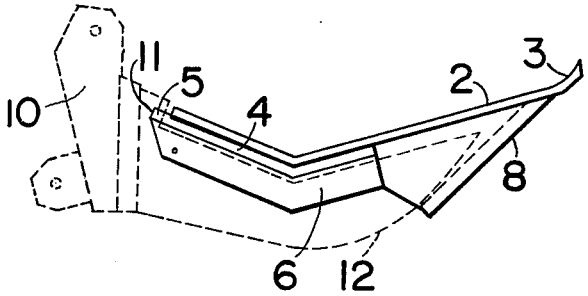

In describing the invention reference will be made to the attached drawings in which, FIG. 1 is a top view of the invention with some invisible components omitted for clarity, FIG. 2 is a side elevation of the invention, FIG. 3 is a bottom view of the invention, FIG. 4 is a view of section A—A of FIG. 2 and, FIG. 5 is a view showing the manner of attachment of the invention to an existing ripper.

The invention, which is a device for converting a ripper into a ripper-trencher, will be referred to as a converter in the following specification. The converter 1 consists of an upper elongated plate 2 which terminates at its outer digging end into an upwardly bent sharp edged, digging tool 3.

The plate 2 is provided on its under side and inner end with a slightly narrower plate 4 which extends a short distance beyond the said inner end to form a ledge 5, the purpose of which is to be inserted into a reentrant cavity 11 which is a regular part of the standard ripper as shown in FIG. 5.

To the lower plate 4 is attached a pair of parallel spaced side walls 6,6. The space 7 between these side walls is made just wide enough the contain the upper edge of the ripper 10 upon which the converter 1 sits. The upper plate 2, the lower plate 4, and the side walls 6,6, are bent to fit contour of the upper edge of the ripper 10.

The plate 2 is provided on its underside with a wedge shaped pocket 8 which is located between the ends of the side walls 6,6 and the digger edge 3. When the converter 1 is fitted over the ripper 10, the horn-shaped part 12 of the said ripper is contained within the pocket 8.

To provide an additional tie between the ripper 10 and the converter 1, a hole 9 is provided in each side wall 6 and a corresponding hole in the ripper so that a pin or bolt can be passed through these holes.

In view of the very heavy work involved in the ripping and digging operation, the converter 1 is preferably built of heavy steel sections to withstand the stress and wear.

The upper plate 2 and its digger 3 are of the same width and both are of a width equal to the final width of the trench which is to be dug. Thus the converter can be made of various widths to correspond to the size of the required trench.

1. In combination, a ripper of a back-hoe machine and a converter for converting the ripper to a ripper-trencher for digging a trench of predetermined width, said ripper having an upper edge with a sharp bend therein forming an obtuse angle, an inner end, and a horn-shaped outer end, the inner end of said ripper having a hole therein and a reentrant cavity adjacent the upper edge; said converter comprising an elongate, flat rectangular upper plate having an inner end and terminating at an outer end in a sharp-edged digger, said upper plate having a sharp bend therein forming an obtuse angle substantially equal to the obtuse angle of said upper edge, the width of said upper plate and the digger being of the same width and substantially equal to the width of the trench to be dug, a separate lower plate attached to the lower surface of said upper plate and being narrower and shorter than said upper plate, said lower plate also having a sharp bend therein forming an obtuse angle substantially equal to the obtuse angle of said upper plate, said lower plate extending a short distance beyond the inner end of the upper plate to form a ledge, said ledge being received in said reentrant cavity of said ripper, a pair of vertical, parallel side walls attached to said lower plate and spaced apart a distance slightly greater than the thickness of said ripper to provide an elongate cavity to receive the upper edge of said ripper, said side walls also being bent to conform with the contour of the upper edge of said ripper, an additional plate positioned at an angle with respect to an outer end portion of said upper plate, and additional side walls attached to said additional plate, spaced outwardly from said side walls, and extending beyond the forward ends of said side walls, said additional plate and said additional side walls forming a hollow, wedge-shaped pocket with said upper plate at the underside of said upper plate just behind said sharp-edged digger to receive and contain therein the horn-shaped end of said ripper, said side walls of said converter having holes therein positioned to be aligned with said ripper hole when said horn-shaped end of said ripper is received in said wedge-shaped pocket.

* * * * *